US007014041B1

(12) United States Patent
Rosen et al.

(10) Patent No.: US 7,014,041 B1
(45) Date of Patent: Mar. 21, 2006

(54) METHOD OF APPLYING FLOWABLE MATERIAL AND CONTAINER THEREFOR

(75) Inventors: Ian Kurt Rosen, North Muskegon, MI (US); Charles E. Hiddema, Muskegon, MI (US); Gary L. Scholten, Hudsonville, MI (US)

(73) Assignee: American Grease Stick Company, Muskegon, MI (US)

( * ) Notice: Subject to any disclaimer, the term of this patent is extended or adjusted under 35 U.S.C. 154(b) by 394 days.

(21) Appl. No.: 10/338,378

(22) Filed: Jan. 8, 2003

Related U.S. Application Data

(60) Provisional application No. 60/347,106, filed on Jan. 9, 2002.

(51) Int. Cl.
*B65D 85/00* (2006.01)

(52) U.S. Cl. ..... 206/447; 206/460

(58) Field of Classification Search ..... 206/524.1, 206/447, 460, 338; 222/95, 107
See application file for complete search history.

(56) References Cited

U.S. PATENT DOCUMENTS

| | | | | | |
|---|---|---|---|---|---|
| 1,625,968 | A | * | 4/1927 | Ware | 222/95 |
| 2,147,349 | A | * | 2/1939 | Piquerez | 222/107 |
| 2,293,589 | A | * | 8/1942 | Calvert | 206/524.6 |
| 2,901,099 | A | | 8/1959 | Krieble | |
| 2,904,419 | A | * | 9/1959 | Couch et al. | 206/524.1 |
| 3,029,939 | A | | 4/1962 | Feldman | |
| 3,108,433 | A | | 10/1963 | De Fries et al. | |
| 3,189,227 | A | | 6/1965 | Hobbs et al. | |
| 3,254,828 | A | | 6/1966 | Lerner | |
| 3,380,578 | A | | 4/1968 | Sparks | |
| 3,469,655 | A | * | 9/1969 | Moreno | 184/109 |
| 3,522,177 | A | | 7/1970 | Benz | |
| 3,540,579 | A | | 11/1970 | Hellstrom | |
| 3,634,129 | A | | 1/1972 | Benz | |
| 3,931,885 | A | | 1/1976 | Nahill et al. | |
| 3,963,124 | A | | 6/1976 | Banks | |
| 4,026,413 | A | | 5/1977 | Britt et al. | |
| 4,238,541 | A | | 12/1980 | Burton | |
| 4,425,065 | A | | 1/1984 | Sweeney | |
| 4,681,222 | A | | 7/1987 | Longhenry | |
| D330,326 | S | | 10/1992 | Honeycutt | |
| 5,405,022 | A | | 4/1995 | Rissley | |

FOREIGN PATENT DOCUMENTS

| | | |
|---|---|---|
| FR | 1344782 | 11/1963 |
| FR | 1376625 | 10/1964 |

* cited by examiner

*Primary Examiner*—Bryon P. Gehman
(74) *Attorney, Agent, or Firm*—Van Dyke, Gardner, Linn & Burkhart, LLP

(57) ABSTRACT

A container for housing flowable material, such as grease, adhesive, lubricant, or other materials, is disclosed that facilitates the application of the flowable material onto a workpiece. The container may include ribs or other guide structures that direct or limit the flow of the material after the workpiece is inserted into the container, and its contents manually squeezed. The squeezing of the container directs the flowable material onto the workpiece without the need for a separate applicator and without the need to manually touch the flowable material.

27 Claims, 6 Drawing Sheets

METHOD OF APPLYING FLOWABLE MATERIAL AND CONTAINER THEREFOR

This application claims priority to commonly-titled U.S. provisional application serial No. 60/347,106, filed Jan. 9, 2002, the disclosure of which is hereby incorporated herein by reference.

BACKGROUND OF THE INVENTION

This invention relates generally to containers for flowable materials, such as lubricants and adhesives, and more particularly for a specialized container and method for applying the flowable material of the container to a desired object.

In the past, the application of lubricants or adhesives to objects has involved expelling the lubricant or adhesive from a container—such as a tube, can, bag, or other structure—onto either the object itself or a separate applicator which is then used to coat the object. For example, the greasing of wheel bearings has usually involved scooping or otherwise removing the grease from a container and then spreading and packing with pressure the grease appropriately into the desired area. In some instances, the grease is first removed from a container and then put into a specialized grease gun before being applied to the desired object. As another example, it is sometimes desirable to coat the exterior of a screw or other type of fastener with an adhesive. This task has also involved removing the adhesive from the container and subsequently spreading it on the desired areas. In both instances, the tasks are often messy, time-consuming, and involve purchasing more lubricant or adhesive than is necessary. Other methods of applying flowable materials have involved dipping, dunking, painting or brushing on said materials to the workpiece either manually or with tools. Specialized applicators have also been used in the past, but such applicators add undue expense and further complicate the application process. The need can therefore be seen for a manner of substantially overcoming these and other disadvantages of the prior art.

SUMMARY OF THE INVENTION

Accordingly, the present invention provides an improved method and apparatus for dispensing flowable materials, such as grease, adhesives, or other substances. The present invention allows objects to be inserted directly into a container where they are covered with the flowable material by squeezing of the container.

According to one embodiment of the present invention, a method is provided for applying a flowable or viscous material to an object that includes providing a package having a pouch containing the flowable material; providing a removable seal that covers at least a portion of the pouch; and providing at least one flexible wall in the pouch. At least a portion of the seal is removed from the pouch and an object is inserted into the pouch. The pouch is squeezed to direct the flowable material onto the object and the object is then removed from the pouch.

According to another aspect of the invention, a package for flowable material is provided that includes at least one flexible wall and at least one opening for partially inserting an object to be coated with the flowable material. A plurality of integral structures are defined in the flexible walls and are adapted to retard spillover of the flowable material out of the package and to help retain the material within the package as pressure is exerted on the sidewalls.

In still other aspects of the invention, the flowable material may be a lubricant, such as grease, or an adhesive. The pouch may be shaped to correspond to the shape of the object to be covered by the flowable material. The object itself may be a bearing. The seal may be made of a flexible material that allows its use in wiping excess flowable material off of the object after it is removed from the pouch. The guide structure may include a plurality of ribs which may be shaped to conform to an exterior surface of the object. The pouch may also be doughnut shaped. The pouch may have integral structures to retard outflow of the material outside of the package during the squeezing compression. The container may also include a foldable flap that can be folded over an opening in the container after an object has been inserted therein to prevent outflow of the flowable material.

The method and package of the present invention provide an improved technique for applying flowable material to objects. Because the flowable material does not need to be removed from the package prior to being applied to the object, but instead allows direct transfer of the material from the pouch to the object, the messiness of the application process is reduced. Further, the size of the package can be set to provide a sufficient amount of flowable material for a single application, thus allowing the container to be discarded after use without leaving any, or very little, unused material. Further, the flowable material container is shaped to allow easy application of the material to the selected object. The package can also be manufactured in an inexpensive manner. These and other advantages of the present invention will be apparent to one skilled in the art in light of the following specification when read in conjunction with the accompanying drawings.

DETAILED DESCRIPTION OF THE PREFERRED EMBODIMENTS

Figure 1:
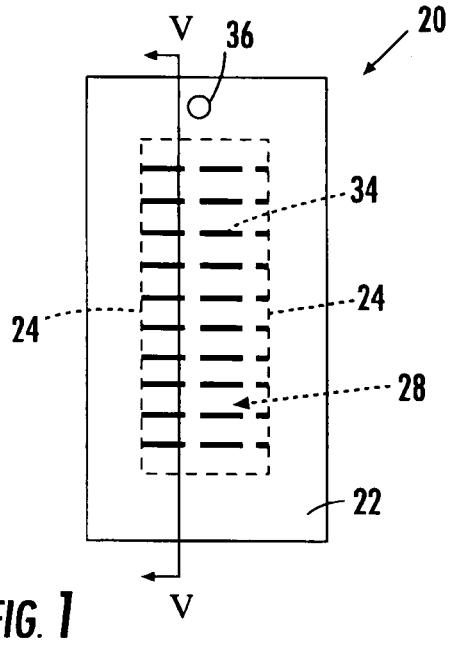
FIG. 1 is a plan view of a package according to one embodiment of the present invention.
Figure 2:
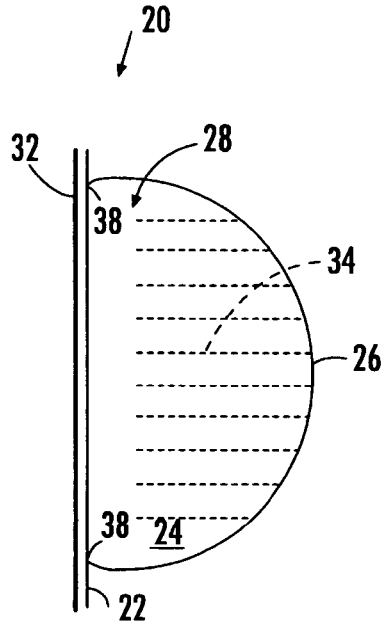
FIG. 2 is a side, elevational view of the package of FIG. 1.

The present invention will now be described with reference to the accompanying drawings wherein the reference numerals in the following description correspond to like-numbered elements in the several drawings. A package 20 according to one embodiment of the present invention is depicted in FIGS. 1–5. Package 20 includes a generally planar top 22, a plurality of sidewalls 24, and a bottom 26. The sidewalls 24 and bottom 26 generally define a pouch 28 for holding a flowable material, such as an adhesive or a grease-type lubricant. A hole 36 is defined in top wall 22 for receiving a hook or other support structure that allows package 20 to be hung on a retail display unit, or in another location.

Figure 4:
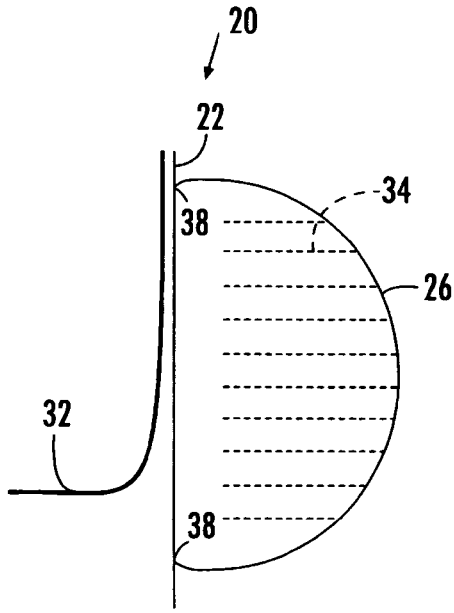
FIG. 4 is a side, elevational view of the package of FIG. 1 shown with a seal partially removed.
Figure 5:
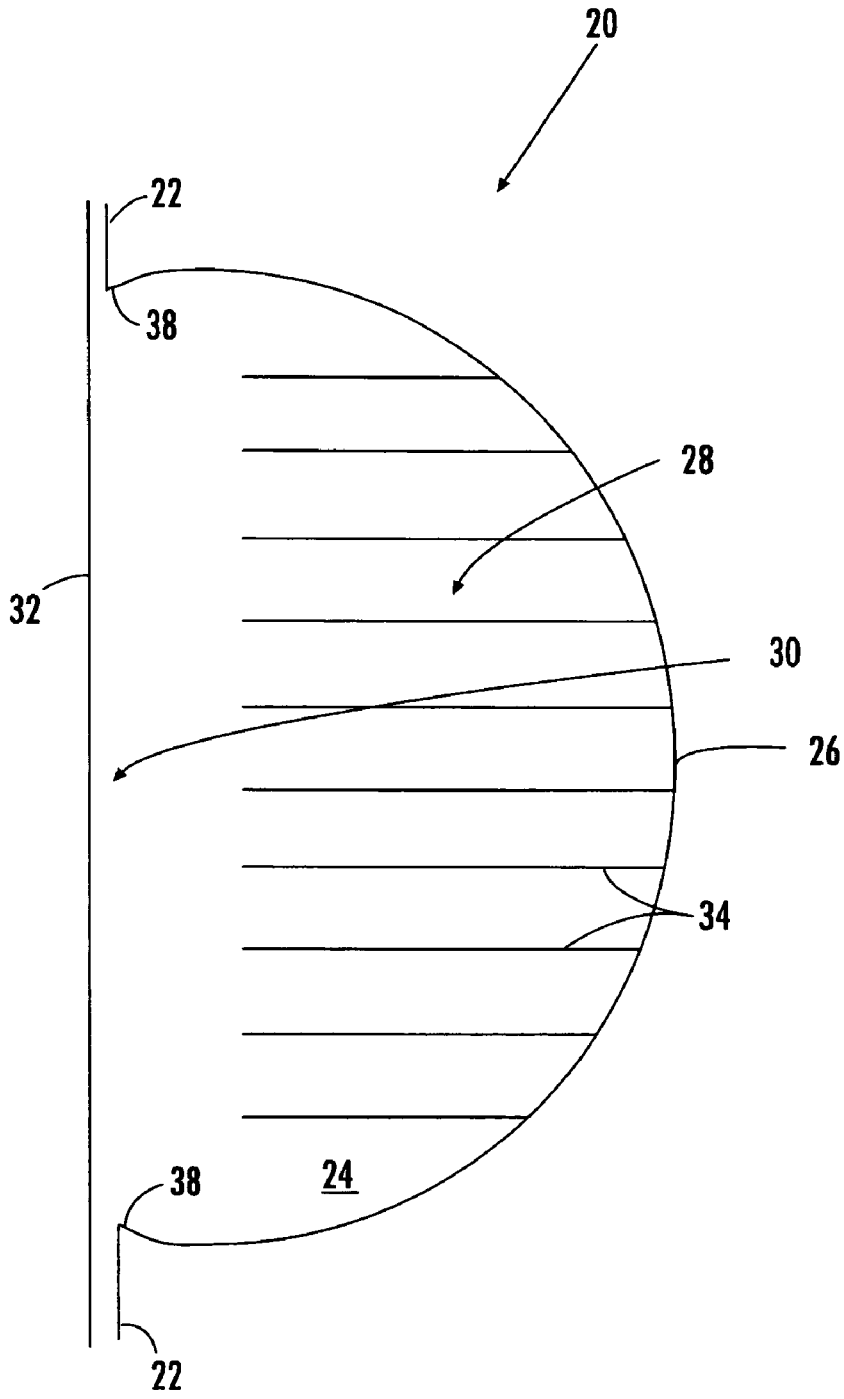
FIG. 5 is a cross-sectional view of the package of FIG. 1 taken along the line V—V.
Figure 6:
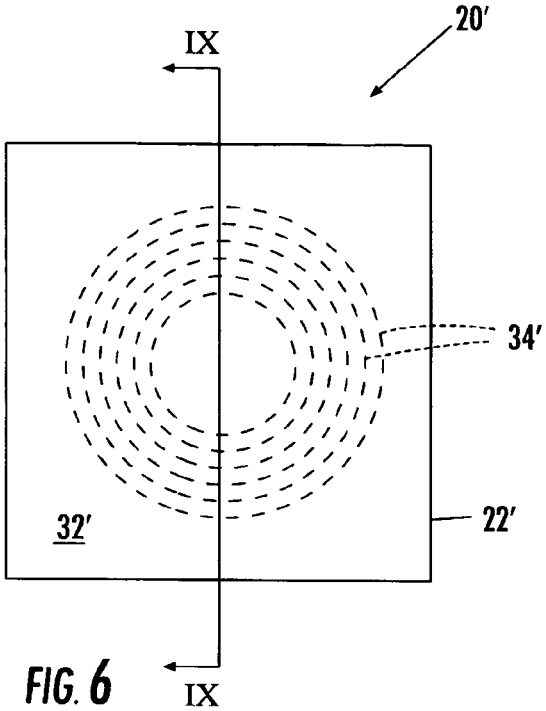
FIG. 6 is a plan view of a package according to a second embodiment of the present invention.
Figure 7:
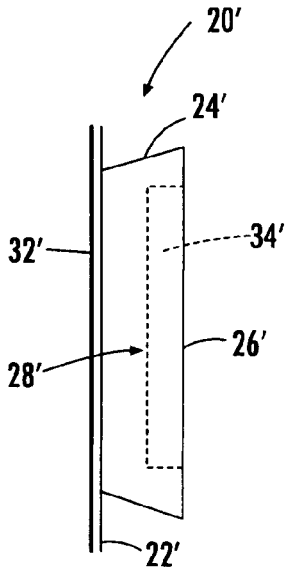
FIG. 7 is a side, elevational view of the package of FIG. 6.
Figure 8:
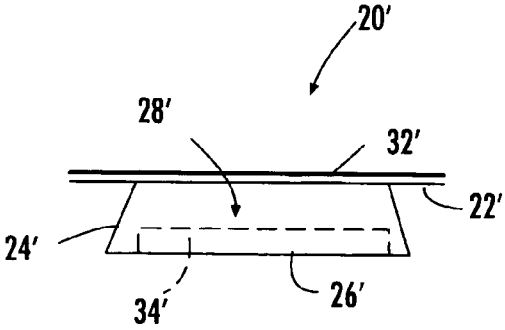
FIG. 8 is a front elevational view of the package of FIG. 6.
Figure 9:
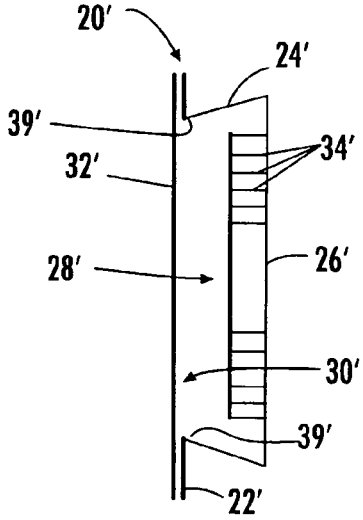
FIG. 9 is a cross-sectional view of the package of FIG. 6 taken along the line IX—IX.
Figure 10:
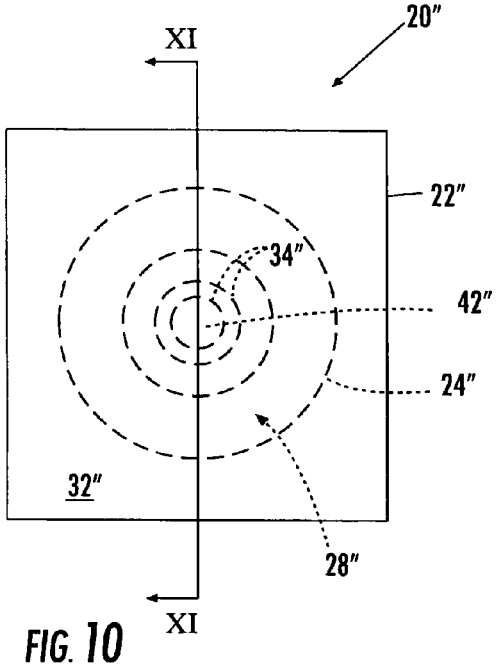
FIG. 10 is a plan view of a package according to a third embodiment of the invention.
Figure 11:
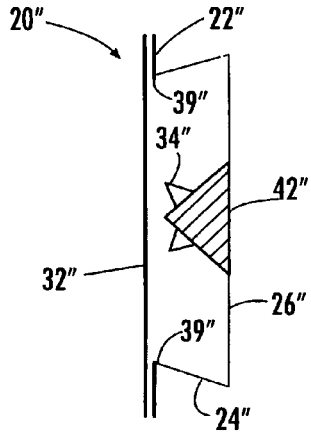
FIG. 11 is a cross-sectional view of the package of FIG. 10 taken along the line XI—XI.

Sidewalls 24 and bottom wall 26 are generally flexible so that a person can squeeze these walls to expel the contents of pouch 28. Sidewalls 24 and bottom wall 26 may be made out of any suitable plastic material. Top 22 includes an opening 30 (FIG. 5) generally defined above at least a portion of pouch 28. A removable seal 32 is affixed to top 22 and covers opening 30 until a person desires to access the material in pouch 28, in which case the person peels seal 32 off of top 22 in a manner similar to the seals on packets of jelly, butter, or other items. Seal 32 may be a foil type of material, or another type of material. An illustration of seal 32 partially peeled away from top 22 is shown in FIG. 4. It should be noted that seal 32 is adhered to top 22 by an appropriate adhesive, or by other means, and that the space between seal 32 and top 22 in the drawings is exaggerated for clarity of illustration only.

A plurality of ribs or guide structures 34 are defined in the bottom of pouch 28 and extend upwardly from bottom wall 26 and inwardly from sidewalls 24. Ribs 34 are illustrated as being generally straight and parallel to each other, with a generally uniform spacing between each of them. The shape, orientation, and spacing of ribs 34 can be varied from that illustrated in a wide variety of manners, some of which are more fully discussed below. Ribs 34 help direct the flow of the material in pouch 28 when it is to be expelled onto an object, such as a wheel bearing, or other type of object.

Seal 32 is preferably a hermetic seal that allows the contents of package 20 to be stored for long periods of time without contamination, spoliation, evaporation, or drying of the contents of package 20. When it is desired to use the flowable material inside of package 20, seal 32 is peeled away from top wall 22 (FIG. 4). Seal 32 may be peeled away either wholly or partially. In either case, seal 32 may thereafter be used to wipe excess flowable material off of the object to be coated, as will be described in more detail below. After seal 32 has been peeled away from top 22 to allow sufficient exposure to opening 30, the object to be coated is inserted into pouch 28. In the embodiment of FIGS. 1–5, the container 20 is specifically designed to accommodate applications of flowable material onto disk shaped objects, such as grease onto wheel bearings. Bottom wall 26 of pouch 28 is generally semi-circular to match half of the exterior of a round wheel bearing. After inserting the wheel bearing, or other object, at least partially into pouch 28, the pouch 28 is manually squeezed to force the flowable material onto the inserted object. The object may be rotated while in pouch 28 to better spread the flowable material onto the desired surfaces of the object. In the case of a wheel bearing, it may be desirable to coat one half of the wheel bearing, remove it from pouch 28, and then insert the other half of the wheel bearing into pouch 28 for coating. Ribs 34 help guide the flowable material evenly onto all areas of the inserted object when pouch 28 is compressed. Ribs 34 are an optional feature of container 20 and can be completely eliminated, if desired.

Figure 3:
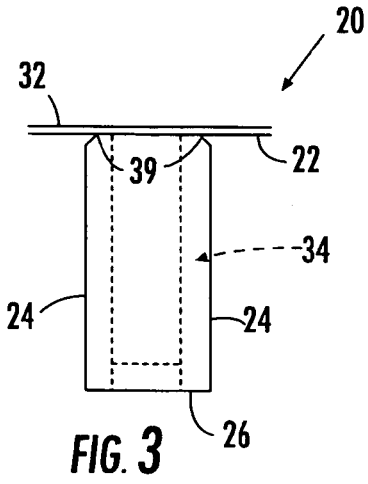
FIG. 3 is a front, elevational view of the package of FIG. 1.

After the object is sufficiently coated with the flowable material, it is retracted out of pouch 28. While retracting the object out of pouch 28, it may be desirable to squeeze together the sidewalls 24 so that edges 39 of sidewalls 24 contact the periphery of the object (FIG. 3). In this manner, the edges 39 will scrape off excess flowable material from the object as it is removed. In the event more of the flowable material is desirably removed from the object after complete retraction out of pouch 28, seal 32 can be used to wipe off as much of the flowable material as is desired. Seal 32 can also be used to grip the coated half of the wheel bearing while the uncoated half is inserted into pouch 28 for coating.

Bottom wall 26 also includes edges 38 adjacent its junction with top 22. Edges 38 may be positioned apart from each other slightly less than the diameter of the wheel bearing, or other disk-shaped object, so that they will have to flexibly expand away from each other slightly to accommodate the insertion of the wheel bearing. Edges 38 are thereby in contact with the outer periphery of the wheel bearing as it is removed from pouch 28. This contact causes edges 38 to scrape off excess grease from the bearing's periphery as it is removed from pouch 28. Edges 38 also help to prevent outflow of grease while pouch 28 is manually squeezed.

Package 20 therefore provides an easy and convenient method of storing flowable materials, as well as an easy and convenient applicator for transferring the stored material onto a desired object. Rather than having to first remove the material from the pouch and then spread it onto the object, package 20 allows the material to be applied while still in pouch 28, thereby reducing the messiness of the application process. For example, a bearing can easily be greased by way of package 20 by simply inserting the bearing into pouch 28, squeezing it, and thereafter removing the bearing from pouch 28. Very little, if any, grease will come into contact with the user's hands, and little or no effort needs to be made to ensure that the grease is distributed about the entirety of the bearing. Further, package 20 can be manufactured in a relatively inexpensive manner. Package 20 may be filled to only a fraction of its capacity with the flowable material in order to allow an object to be inserted therein initially without causing the flowable material to be expelled out of the package. The amount of flowable material may be chosen based on the intended application of the flowable material.

Figure 12:
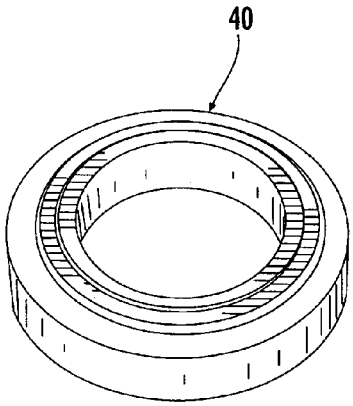
FIG. 12 is a perspective view of a bearing.
Figure 13:
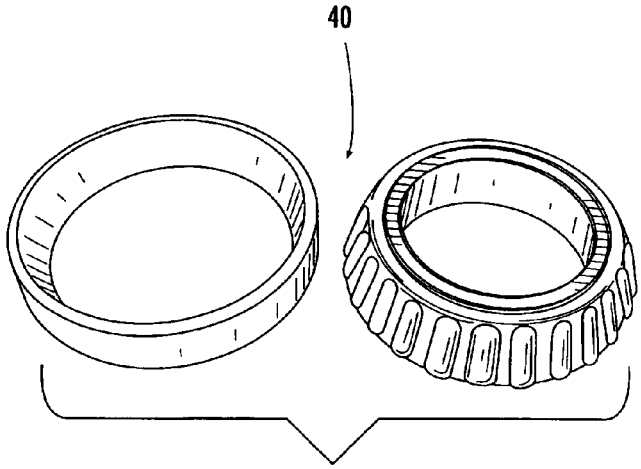
FIG. 13 is a perspective view of the bearing of FIG. 12 illustrated disassembled.

The size and shape of pouch 28 may vary substantially from that of package 20. As two additional examples, packages 20' and 20" are depicted in FIGS. 6–9 and FIGS. 10–11, respectively. Many further variations of the size and shape of the pouch are also possible. The pouch 28' of package 20' has a circular shape when viewed from above, with a plurality of spaced, circular ribs 34' extending upwardly from bottom wall 26'. Pouch 28' is especially adapted for applying flowable material to circular objects, such as grease to the bearing 40 of FIGS. 12–13. While not required, pouch 28' may desirably have the same diameter as that of the bearing intended to be greased by the contents of package 20'.

The pouch may also include a raised center 42, such as that illustrated in package 20". The presence of raised center 42 gives pouch 28" a generally doughnut-shaped interior. Raised center 42 may desirably be dimensioned to fit within the central opening of the bearing to help prevent excessive grease from flowing through this opening when pouch 28" is compressed. Raised center 42 may include a plurality of ribs or projections 34' that are shaped and dimensioned to help guide the flowable material into the areas of the bearing to be greased. Additionally, package 20" may include ribs or projections positioned on bottom wall 26" (not shown) and/or ribs or projections positioned on sidewalls 24" (also not shown).

Figure 14:
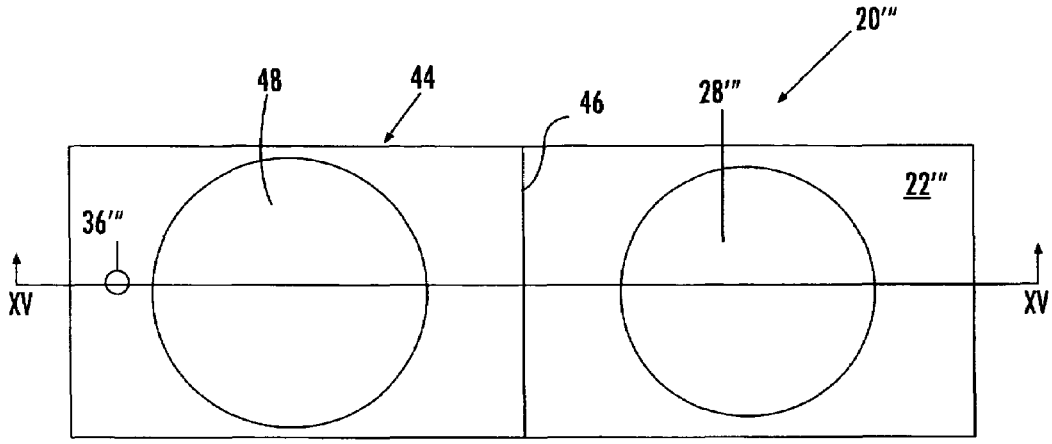
FIG. 14 is a plan view of a container according to a fourth embodiment of the present invention.
Figure 15:
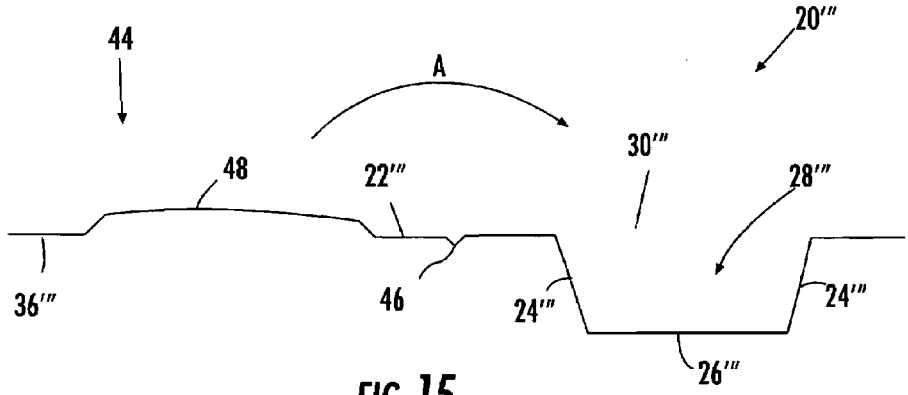
FIG. 15 is a cross-section of the container of FIG. 14 taken along the line XV—XV.
Figure 16:
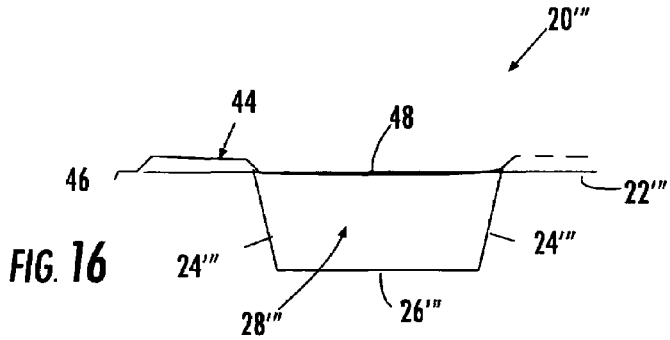
FIG. 16 is a reproduction of FIG. 15 illustrated with a flap folded over.

Another embodiment of a package 20" is depicted in FIGS. 14–16. Package 20'" includes a pouch 28'" which is generally disk shaped and dimensioned to receive a wheel bearing. Pouch 28'" contains grease or other viscous material. Package 20'" includes a top 22'" over which a foil seal is placed (not shown), like seal 32 of package 20. Package 20'" further includes a foldable flap 44, a fold line 46, and a raised area 48. Raised area 48 is shaped the same as the periphery of pouch 28'" and preferably, although not necessarily, dimensioned slightly larger than the periphery of pouch 28'". After the seal over pouch 28'" has been removed, a wheel bearing to be greased is inserted into pouch 28'" with its axis perpendicular to bottom wall 26'". Foldable flap 44 is then folded over in the direction indicated by arrow A (FIG. 15) until raised area 48 contacts the periphery of pouch 28'". By having a user maintain pressure on raised area 48 so that it pushes against the periphery of pouch 28'", an essentially leakproof enclosure is formed about the bearing in pouch 28'". Applying sufficient pressure to sidewalls 24'", bottom wall 26'" or raised area 48 will cause the grease in pouch 28'" to be squeezed into the orifices of the wheel bearing. After the bearing is sufficiently coated, flap 44 is folded back and the bearing removed from pouch 28'". Package 20'", with the exception of the seal, may advantageously be stamped or otherwise manufactured from a single sheet of material to reduce cost. Sidewalls 24'" may include edges (not shown) adjacent their top ends like those of edges 38 and 39, described previously, that help to limit outward flow of the material, as well as to scrape off excess material as the coated object is removed from pouch 28'".

Figure 17:
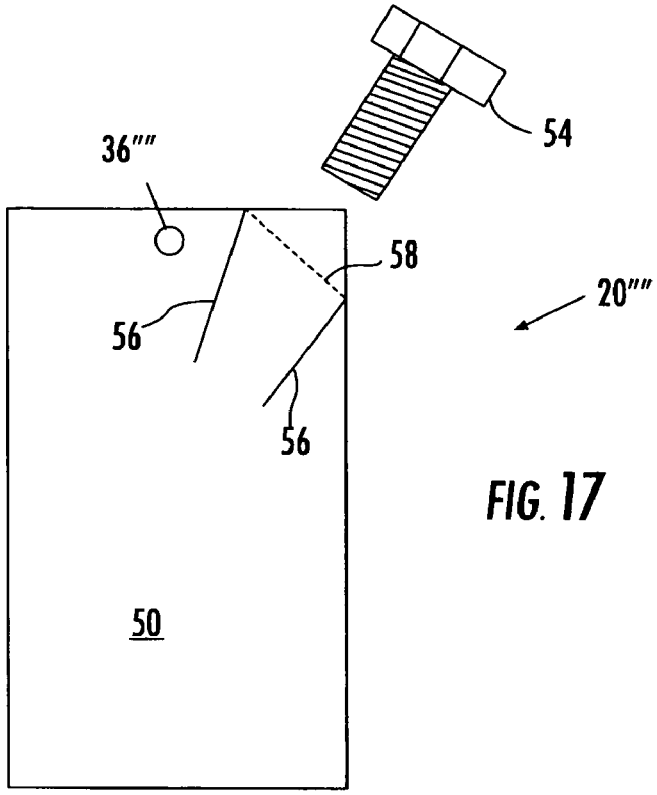
FIG. 17 is a front, elevational view of a container according to a fifth embodiment of the invention.
Figure 18:
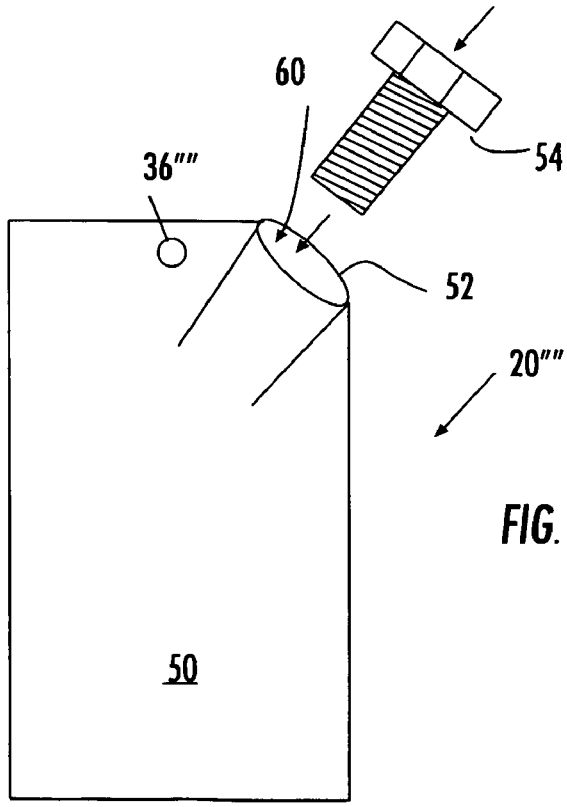
FIG. 18 is a perspective view of the container of FIG. 17 shown with a corner cut off.

Another package 20"" is depicted in FIGS. 17–18. Package 20"" is generally constructed of a front sheet 50 and back sheet 52 attached together at their peripheries to define an internal space. The construction may be identical to the construction of conventional ketchup packets available in restaurants and elsewhere. The contents of package 20"", however, is not ketchup, but rather an adhesive or other material intended to be applied to an elongated structure, such as a screw 54. Package 20"" includes a pair of ribs, or other integral structures, 56 that connect together the front and back sheets along their lengths. Preferably, the ribs 56 are tapered inwardly toward each other slightly at their innermost extension. When an object is to be coated with the contents of package 20"", the package is first cut or torn along dashed line 58. This cutting or tearing creates an opening 60 into which screw 54, or another elongated object, can be inserted. When so inserted, ribs 56 help prevent outflow of the contents of package 20"" as it is squeezed, and also scrape off excess flowable material from the periphery of screw 54 as it is removed from package 20"". By being tapered inwardly, ribs 56 help ensure that they will contact the periphery of screw 54 at least somewhere along its shaft, regardless of the diameter of screw 54's shaft. When screw 54 is inserted in package 20"", the contents may be better spread onto the exterior of screw 54 by rotating it, squeezing package 20"", or a combination thereof. Ribs 56 may be spaced apart from each other a distance that accommodates whatever object or objects that are intended to be coated with the contents of package 20"".

In any of the embodiments of the package of the present invention, the internal ribs 34, if included, may be dimensioned such that they generally conform to the shape of an exterior surface of the item to be coated. In some instances, such as when used with bearing grease, the pouch may have a volume that corresponds to the amount of grease that would normally be applied in one application of grease to the bearing. After application of the grease, little, if any, unused grease remains in the package and it can be discarded with minimal waste. Alternatively, package 20 may contain sufficient flowable material for multiple applications.

Sidewalls 24 are illustrated in the drawings as being straight and curved inwardly at their top ends. This orientation helps create the upper edges 39 that tend to remove excess flowable material when the object is removed from pouch 28. It will be understood that the shape of sidewalls 24 can vary significantly from that illustrated. As but one example, sidewalls 24 and bottom wall 26 could be joined together to form a single curved wall. Other variations are possible.

The ribs 34 in the various embodiments can also vary substantially from that depicted in the attached drawings. Ribs 34 may have different heights, widths, stiffnesses, spacings, and positions, from that shown in the drawings. In any of the possible variations of the ribs, the goal of the rib design is to help direct the flow of the material onto the object, rather than having the material flow internally in the pouch in response to pressure being applied to the pouch.

While the present invention has been described in terms of the preferred embodiments depicted in the drawings and discussed in the above specification, along with several alternative embodiments, it will be understood by one skilled in the art that the present invention is not limited to these particular embodiments, but include any and all such modifications that are within the spirit and the scope of the present invention as defined in the appended claims.

What is claimed is:

1. A method of applying a viscous material to a threaded fastener, said method comprising:

providing a package having a pouch containing the viscous material, said pouch comprising at least one flexible wall;

creating an opening in said pouch for accessing the viscous material in said pouch;

inserting a threaded portion of a threaded fastener through said opening and into said pouch while maintaining a head portion of the threaded fastener outside of said pouch;

squeezing said at least one flexible wall of said pouch to direct the viscous material onto the threaded portion of the threaded fastener in said pouch while the head portion of the threaded fastener is outside of said pouch so as to coat the threaded portion of the threaded fastener in said pouch with the viscous material while limiting coating of the head portion of the threaded fastener; and removing the coated threaded portion of the threaded fastener from said pouch by grasping the head portion of the threaded fastener and moving the threaded fastener in a direction away from said pouch.

2. The method of claim 1 including grasping the head portion of the threaded fastener and rotating the threaded fastener while the threaded portion of the threaded fastener is within said pouch to enhance coating of the threaded portion of the threaded fastener.

3. The method of claim 1 wherein said at least one flexible sidewall contains integral structures to facilitate and direct application of viscous material to the threaded portion of the threaded fastener and to minimize outflow of the viscous material away from threaded fastener or outside of the package during squeezing of said at least one sidewall and removing the threaded fastener from said pouch.

4. The method of claim 1 wherein the viscous material comprises a lubricant.

5. The method of claim 1 wherein the viscous material comprises a grease.

6. The method of claim 1 wherein the viscous material comprises an adhesive.

7. The method of claim 1 wherein said pouch is shaped to generally correspond to the shape of the threaded portion of the threaded fastener.

8. The method of claim 1 wherein said pouch includes a pair of ribs formed at said opening and defining a passageway within said pouch for insertion of the threaded portion of the threaded fastener therein, said ribs directing application of viscous material to the threaded portion of the threaded fastener.

9. The method of claim 1 wherein integral guide structures are defined in said pouch, said integral guide structures functioning to retard movement of excess viscous material through said opening in said pouch.

10. The method of claim 1 wherein said pouch contains two generally parallel sidewalls joined together by seams at their edges with the viscous material sandwiched in between said two sidewalls.

11. The method of claim 10 wherein said sidewalls have a shaped guide structure impressed or integrally built into said sidewalls.

12. A package of flowable, viscous material, said package comprising:

at least one flexible wall; and at least one opening for inserting a portion of an object within the package so that the inserted portion of the object is coated with said viscous material while a non-inserted portion of the object is outside of said package and substantially not coated with said viscous material, said at least one flexible wall having integral structures that define a passageway at said opening for receiving the inserted portion of the object therein, said integral structures limiting flow-over of said viscous material outside of the package and substantially retaining the viscous material within the package as pressure is exerted on said at least one flexible wall.

13. The package of claim 12 wherein said viscous material comprises a lubricant.

14. The package of claim 12 wherein said viscous material comprises a grease.

15. The package of claim 12 wherein said viscous material comprises an adhesive.

16. The package of claim 12 wherein the object comprises a threaded fastener.

17. The package of claim 16 wherein said integral structures comprise ribs that are generally funnel shaped.

18. The package of claim 17 wherein said at least one flexible wall comprises a pair of flexible walls that are joined together around their perimeter edges to define a cavity for containing the viscous material, said ribs being formed by selectively joining said flexible walls inward of their joined perimeter edges.

19. The package of claim 12 wherein said package is shaped generally the same as the inserted portion of the object.

20. The package of claim 12 wherein the inserted portion of the object can be inserted into said package simultaneously while the non-inserted portion of the object is outside the package.

21. A method of applying a viscous flowable material into or onto threads of a threaded fastener by partially inserting a threaded portion of the threaded fastener through an opening of and into a pouch with flexible walls while a head portion of the threaded fastener is outside of said pouch, and manually directing a viscous material within said pouch to the threaded portion of the threaded fastener by compressing the flexible walls of said pouch.

22. The method of claim 21 wherein said flexible walls are joined together around their perimeter edges to define said pouch therebetween.

23. The method of claim 22 including providing ribs in said pouch that are shaped to generally conform to the shape of the threaded portion of the threaded fastener.

24. The method of claim 23 wherein said ribs are defined by the connection of said flexible walls inward of their joined perimeter edges.

25. A method of applying flowable material from a cavity confined by flexible outer walls of a package, said method comprising:

providing a package having a pair of flexible outer walls joined together at their peripherics to define a cavity therebetween, said cavity containing flowable material therein, said flexible outer walls being selectively joined together inward of their peripheries to define a pair of structural ribs that define a passageway between said cavity and an outer portion of said package;

creating an opening at said outer portion of said package and generally at an outer end of said passageway;

inserting an inserted portion of a workpiece through said opening and at least partially into said passageway while retaining a non-inserted portion of the workpiece outside of said package; and directing the flowable material to the inserted portion of the workpiece by exerting compressive pressure on said flexible outer walls, said structural ribs limiting outflow of the flowable material from said package and onto the non-inserted portion of the workpiece.

26. The method of claim 25 including grasping the non-inserted portion of the workpiece that is outside of said package and rotating the workpiece to enhance coating of the inserted portion of the workpiece with the flowable material.

27. The method of claim 25, wherein the workpiece comprises a threaded fastener, whereby the inserted portion of the workpiece comprises a threaded portion of the threaded fastener and a non-inserted portion of the workpiece comprises a head portion of the threaded fastener.

* * * * *